US006182537B1

(12) United States Patent
Vasichek et al.

(10) Patent No.: US 6,182,537 B1
(45) Date of Patent: Feb. 6, 2001

(54) MAGNETIC SPARK PLUG KEEPER ACCESSORY FOR WRENCH SOCKETS

(75) Inventors: Richard A. Vasichek, Brocket; Robert J. Vasichek, Michigan, both of ND (US)

(73) Assignee: Vasichek Enterprises, LLC, Brocket, ND (US)

( * ) Notice: Under 35 U.S.C. 154(b), the term of this patent shall be extended for 0 days.

(21) Appl. No.: 09/184,382

(22) Filed: Nov. 2, 1998

(51) Int. Cl.[7] ..... B25B 13/02

(52) U.S. Cl. ..... 81/125; 81/121.1

(58) Field of Search ..... 81/121.1, 124.6, 81/451

(56) References Cited

U.S. PATENT DOCUMENTS

| | | | | |
|---|---|---|---|---|
| D. 369,075 | | 4/1996 | Vasichek et al. . | |
| 2,491,089 | | 12/1949 | Cowden . | |
| 2,551,553 | | 5/1951 | Wahl . | |
| 2,624,223 | | 1/1953 | Clark . | |
| 2,750,828 | | 6/1956 | Wendling . | |
| 2,778,669 | | 1/1957 | Goodwin . | |
| 2,793,552 | | 5/1957 | Clark . | |
| 2,806,396 | * | 9/1957 | Miller | 81/451 |
| 3,240,087 | | 3/1966 | Estes . | |
| 3,288,002 | | 11/1966 | Mankovitz . | |
| 3,320,563 | | 5/1967 | Clark . | |
| 3,392,767 | | 7/1968 | Stillwagon, Jr. . | |
| 3,630,108 | | 12/1971 | Stillwagon, Jr. . | |
| 3,707,894 | | 1/1973 | Stillwagon, Jr. . | |
| 3,731,722 | | 5/1973 | Carr . | |
| 3,808,918 | | 5/1974 | Carr . | |
| 3,834,253 | | 9/1974 | Carr . | |
| 3,835,737 | | 9/1974 | Carr . | |
| 3,869,945 | | 3/1975 | Zerver . | |
| 3,924,492 | * | 12/1975 | Bray | 81/124.6 |
| 4,663,998 | | 5/1987 | Parsons et al. . | |
| 5,101,695 | * | 4/1992 | Johnson | 81/124.6 |
| 5,146,814 | | 9/1992 | Vasichek . | |
| 5,184,529 | * | 2/1993 | Matsubara et al. | 81/124.4 |
| 5,199,334 | | 4/1993 | Vasichek et al. . | |

(List continued on next page.)

FOREIGN PATENT DOCUMENTS

| | | |
|---|---|---|
| 94 16 4185 U | 12/1994 | (DE) . |
| 196 07 936 | 11/1996 | (DE) . |
| 297 07 519 U | 7/1997 | (DE) . |
| 818530 | 8/1959 | (GB) . |

OTHER PUBLICATIONS

Hold–A–Nut™ Magnetic Inserts, Williams Manufacturing, 929 Washington Street, San Carlos, California 94070 Dated at least as early as Jan. 1994.

*Primary Examiner*—David A. Scherbel
*Assistant Examiner*—Daniel Shanley
(74) *Attorney, Agent, or Firm*—L. Meroy Lillehaugen; Alan Kamrath

(57) ABSTRACT

An accessory (10) for a wrench socket (12) is disclosed including a generally cylindrical magnet (32) secured to a generally cylindrical, nonmagnetic, compressible disk (26) which snugly fits within the well (14) and magnetically insulates the magnet (32) from the socket (12). The accessory (10) is removably insertable into the socket (12) of any design and model and without need for modification of the socket (12) and captures a spark plug (100) slideably received in the well (14) of the socket (12) to magnetically hold the spark plug (100) captive in the well (14) as the socket (12) is moved to the fastening location while not magnetizing the socket (12) or the spark plug (100) sufficiently to be detrimentally magnetically attracted to metal adjacent to the fastening location. Specifically, the connecting nut (112) and insulator (104) of the spark plug (100) are insertable through an axial bore (70) formed in the disk (26) for access to the magnet (32). In a preferred form, the magnet (32) includes an axial passage (72) for slideable receipt of the connecting nut (112). In a further preferred form, an interconnecting bore (76) extends between the axial bore (70) and the magnet (32) for passage of the connecting nut (112).

20 Claims, 1 Drawing Sheet

U.S. PATENT DOCUMENTS 5,277,088 1/1994 Vasichek et al. .
5,542,320 8/1996 Vasichek et al. .
5,603,248 2/1997 Eggert et al. .
5,724,873 * 3/1998 Hillinger ..... 81/451
5,960,681 * 10/1999 Anderson et al. ..... 81/121.1

* cited by examiner

MAGNETIC SPARK PLUG KEEPER ACCESSORY FOR WRENCH SOCKETS

BACKGROUND

The present invention relates generally to accessories for tools for initially holding spark plugs thereto, and particularly to accessories for wrench sockets for initially holding spark plugs captive therein and their method of fabrication.

While installing spark plugs, it is often desirable to maintain the spark plug with the tool until threading is initially underway. Often it was necessary to hold the spark plug relative to the tool with one hand while the tool was manipulated with the other hand. Because of limitations in space, access to the spark plug by the hand holding the spark plug and also by the tool itself was difficult if not impossible. Furthermore, due to the proximity of the hand to the spark plug and the tool, the hand initially holding the spark plug to the tool was especially prone to accidental injury. Thus, there is a well known need in the art for methods for temporarily holding the spark plug to the tool until the threading is initially underway.

Prior to the present invention, keeper accessories utilized rubber or similar material inserts in the socket to frictionally grip the spark plug. However, as frictionally gripping is very dependent upon physical size and coefficient of friction, such approaches have not been entirely satisfactory. Specifically, spark plugs have different configurations between manufacturers, which configurations change over time. Also, such inserts were especially prone to wear due to their frictional interaction with spark plugs such that physical size changed over time. Further, the coefficient of friction also varies with hardness such as the result of temperature or age, environmental conditions such as the presence of grease or oil, and the like.

Several methods have been devised for the use of magnetic forces to retain fasteners to the tool during fastening or removal of the fasteners. However, approaches to use magnetic forces to retain spark plugs to the tool have previously attempted to magnetically attract the body of the spark plug which is the largest magnetic material mass of the spark plug. Acceptance of such prior approaches in the art has been limited due to the inherent deficiencies in such prior approaches. For example, many of such approaches required specially manufactured and designed tools to incorporate the spark plug retention feature and thus could not be utilized when the spark plug retention feature was not desired and could not be utilized with standard tools already in use. Further, many of such approaches magnetized the entire tool so that the tool was not only magnetically attracted to the spark plug but also to any metal in the path of the tool to the fastening location as well as metal surrounding the fastening location such as an engine block. Another approach was to utilize inserts which fit into a larger size of socket for use in installing or removing smaller sized spark plugs corresponding to the size of the insert and not the socket. Furthermore, many of such approaches were of complicated, multipiece designs incapable of being economically manufactured and assembled.

It is thus an object of the present invention to provide a novel accessory for use in a wrench socket without need for modifying the wrench socket and for preventing spark plugs from sliding from the well of the socket to hold the spark plug captive in the well while the socket is being moved to the fastening location and while the spark plug is being initially threaded. In this regard, such a tool will be especially helpful in hard-to-get-at fastening locations and at greater efficiencies. Further, as many accidents happen when working in such hard-to-get-at fastening locations, the accessory will reduce the exposure of injury to the user's hand which was otherwise required to hold the spark plug in the wrench socket. Furthermore, the accessory will reduce the chance of injury due to sharp threads cutting fingers holding the spark plug while trying to initially thread the threaded portion of the spark plug. Likewise, the accessory will allow persons having handicaps or other disabilities to utilize wrench sockets in fastening situations which they otherwise were unable to perform.

It is further an object of the present invention to provide such a novel accessory which captures the spark plug in the well of the socket but also does not magnetize the socket or the spark plug captured therein to such a degree to cause detrimental attraction of the socket and the spark plug to metal surrounding the fastening location. For example, the socket and spark plug will not be attracted to the metal block of an engine as it is moved adjacent thereto to the fastening location. In this regard, the accessory will increase efficiency and productivity. Specifically, the spark plug is captured in the socket in a desired position and will not change orientation and/or fall therefrom due to gravitational forces. Thus, threading of the spark plugs is easier to start with one hand operation.

SUMMARY

Surprisingly, the above objectives can be satisfied in the field of wrench sockets by providing, in the preferred form, an insert accessory for use in a conventional wrench socket without modification. The accessory includes a magnet secured to a nonmagnetic disk in its preferred form by its receipt in a recess formed in the disk. The magnet is smaller than the well of the socket. The disk snugly fits within the well of the socket and magnetically insulates the magnet from the socket.

In other aspects of the present invention, the magnet is held in the recess of the nonmagnetic disk without requiring the use of glue or adhesive especially when the disk is formed of resilient, compressible material.

In further aspects of the present invention, the nonmagnetic disk includes an axial bore of a size for slideable receipt of the connecting nut and the insulator of the spark plug, with the magnet being accessible through the axial bore of the nonmagnetic disk and specifically being proximate to the connecting nut when the insulator is received in the axial bore of the nonmagnetic disk.

In still other aspects of the present invention, the magnet includes an axial passage of a size for slideable receipt of the connecting nut and abuttable with the electrode disk, with the magnet in the most preferred form being annular shaped.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
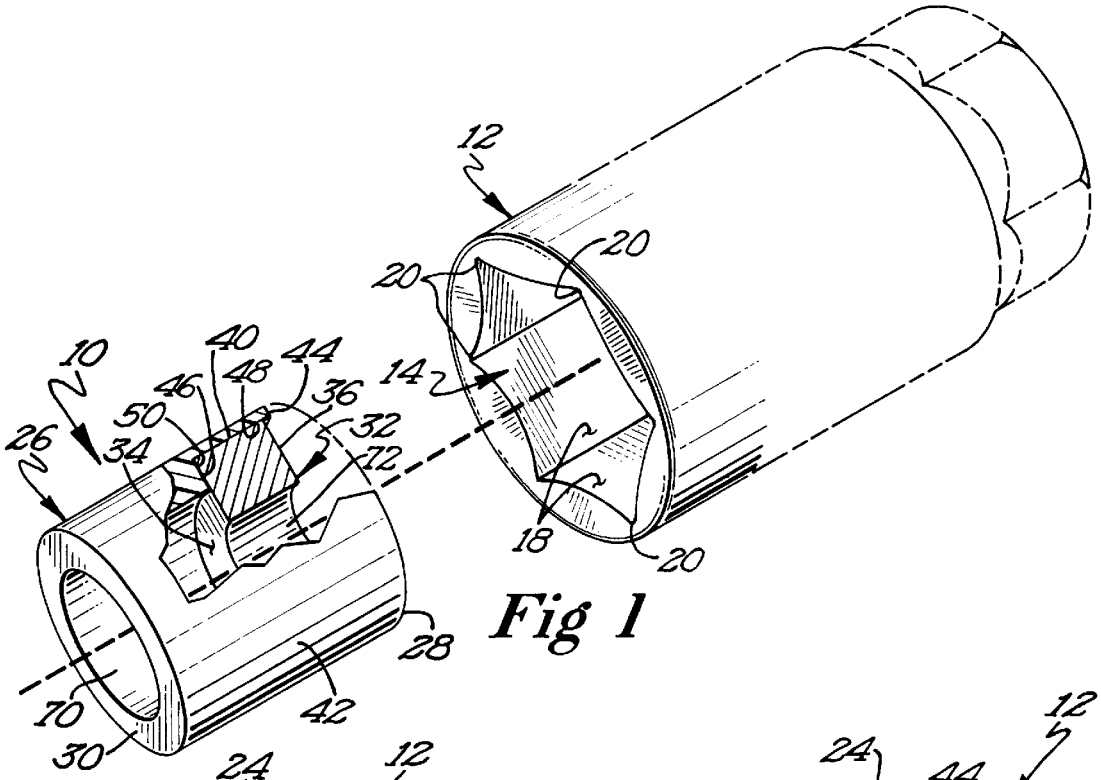
FIG. 1 shows an exploded, perspective view of a spark plug keeping accessory for wrench sockets according to the preferred teachings of the present invention, with portions broken away to show constructional details.

All figures are drawn for ease of explanation of the basic teachings of the present invention only; the extensions of the figures with respect to number, position, relationship, and dimensions of the parts to form the preferred embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "first", "second", "inside", "outside", "inner", "outer", and similar terms are used herein, it should be understood that these terms have reference only to the structure shown in the drawings as it would appear to a person viewing the drawings and are utilized only to facilitate describing the illustrative embodiments.

DESCRIPTION

An accessory for temporarily holding or keeping spark plugs captive with respect to a tool according to the preferred teachings of the present invention is shown in the drawings and generally designated 10. In the most preferred form, accessory 10 is utilized in conjunction with a tool in the form of a wrench socket 12. Generally, spark plug 100 includes a central conductor 102 extending through an insulator 104. A conductive body 106 is suitably secured on the lower portion of insulator 104 and includes a lower threaded portion 108 for threadable receipt such as in an engine head. Conductive body 106 further includes a hexagon nut 110 for purposes of receipt of a tool (such as wrench socket 12) allowing threadable receipt or removal of portion 108 into the engine head. Lower threaded portion 108 typically includes an integrally attached electrode. A connecting nut 112 is threadably received upon central conductor 102 extending beyond the upper end of insulator 104. Connecting nut 112 can be formed of conductive material or could be formed of nonconductive material such as aluminum. In any case, conductor 102 of spark plug 100 typically includes an electrode disk 114 which abuts with the upper end of insulator 104 and against which connecting nut 112 can be threadably tightened, with disk 114 having a radial size greater than connecting nut 112 at least at the point of abutment. Typically, connecting nut 112 has a radial size less than insulator 104 exposed above body 106, with insulator 104 exposed above body 106 in turn having a radial size less than hexagon nut 110.

Socket 12 can be any standard design generally including a well 14 having a multisided periphery sized to axially slideably receive the corresponding sized nut 110 without allowing rotation of nut 110 relative thereto. Specifically, the outer ends of sides 18 forming well 14 intersect at corners 20 arranged at a diameter generally equal to the corners of nut 110, with portions of sides 18 forming well 14 arranged at a diameter less than the diameter of corners 20 or the corners of nut 110. Opposite well 14, socket 12 includes a handle mounting end including a noncircular opening 24 for slideably receiving a complementary shaped shank of any conventional wrench handle. It should further be appreciated that sockets 12 are manufactured with wells 14 of an elongated design and specifically of a depth such that spark plug 100 is able to be inserted in well 14 such that when connecting nut 112 abuts with the handle mounting end of socket 12, hexagon nut 110 is received within well 14 sufficiently to rotatably relate socket 12 and hexagon nut 110 of spark plug 100.

In the preferred form shown, accessory 10 includes a disk 26 of uniform thickness having planar, parallel, opposed faces 28 and 30, with faces 28 and 30 each lying in a single plane in the most preferred form. In the most preferred form, disk 26 includes a periphery 42 having a size at least equal to well 14 such as greater than the minimum diameter of sides 18 and in the most preferred form, generally equal to or slightly smaller than the diameter of corners 20. In the most preferred form, disk 26 is in the form of a sleeve.

Disk 26 is formed of nonmagnetic material and preferably of suitable resilient, compressible material of a flexible nature to allow periphery 42 of disk 26 to be forced into well 14 with the outer periphery 42 elastically deforming to pass inside sides 18 and snugly fit within well 14. In its most preferred form, disk 26 is formed of low density polyethylene having a melting temperature of about 300° F. (150° C.) and which softens resulting in permanent deformation at about 220° F. (105° C.). Further, the fit of disk 26 should be such that disk 26 can be forced from well 14 by passing an elongated member through opening 24 and pushing against face 28 but preventing disk 26 from being shaken out of well 14 even after repeated insertions and removals from well 14.

Accessory 10 further includes a magnet 32 which in the preferred form is a ceramic or neodymium or rare earth element magnet. In the preferred form, magnet 32 is of uniform thickness having planar, parallel, opposed faces 34 and 36, with faces 34 and 36 each lying in a single plane in the most preferred form. Further, magnet 32 has a periphery 40 of a generally cylindrical shape having circular cross sections of a constant diameter less than periphery 42 of disk 26 and less than the minimum diameter of sides 18 of well 14. Additionally, in the most preferred form, magnet 32 includes a nickel-plating to prevent rusting.

In the most preferred form, magnet 32 is permanently secured to disk 26 according to the teachings of the present invention with periphery 40 of magnet 32 being spaced from periphery 42 of disk 26 with annular portion 44 of face 28 of disk 26 extending beyond periphery 40 of magnet 32 according to the preferred teachings of the present invention. In the preferred form shown, disk 26 includes an axial recess 46 extending at a depth from face 28 towards but spaced from face 30 and spaced from periphery 42. Specifically, in the preferred form, recess 46 has a side wall 48 terminating in a lower wall 50 spaced from and parallel to face 28 and located intermediate faces 28 and 30. Recess 46 has a size and shape generally equal to, complementary to and for receipt of periphery 40 of magnet 32. In the preferred form shown, the depth of recess 46 between face 28 and lower wall 50 is generally equal to or slightly greater than the height of magnet 32 between faces 34 and 36 and is less than the height of disk 26 between faces 28 and 30. In the preferred form shown, side wall 48 has a size and shape generally corresponding to periphery 40 and in the preferred form for retaining magnet 32 in recess 46 by a friction or similar interfit and specifically without the use of adhesive, glue, or similar securement method. In this regard, recess 46 can be shaped in a manner as disclosed in U.S. Pat. Nos. 5,199,334; 5,277,088 and/or 6,006,630, which are hereby incorporated herein by reference. However, other manners of holding magnet 32 in recess 46 can be utilized such as disclosed in U.S. Pat. No. 5,542,320 and even less preferably through the use of adhesive, glue, or similar securement method. Recess 46 and thus magnet 32 received therein are positioned generally concentrically within the periphery 42 of disk 26 and thus of well 14. In this regard, recess 46 and magnet 32 can be axially centered in disk 26.

Disk 26 according to the teachings of the present invention includes an axial bore 70 extending axially from face 30 such that magnet 32 in recess 46 is accessible from face 30 of disk 26. Bore 70 is of a radial size generally equal to and preferably slightly larger than the radial size of insulator 104 and different than periphery of recess 46 or in other words than side wall 48. In the form shown in FIGS. 1 and 2, bore 70 is substantially smaller than side wall 48 of recess 46 and periphery 40 of magnet 32 whereas in the form shown in FIG. 3, bore 70 is larger than side wall 48 of recess 46 and periphery 40 of magnet 32. In this regard, bore 70 is preferably of a size such that no compression or binding of disk 26 occurs as the result of the insertion or removal of spark plug 100 in bore 70.

Figure 2:
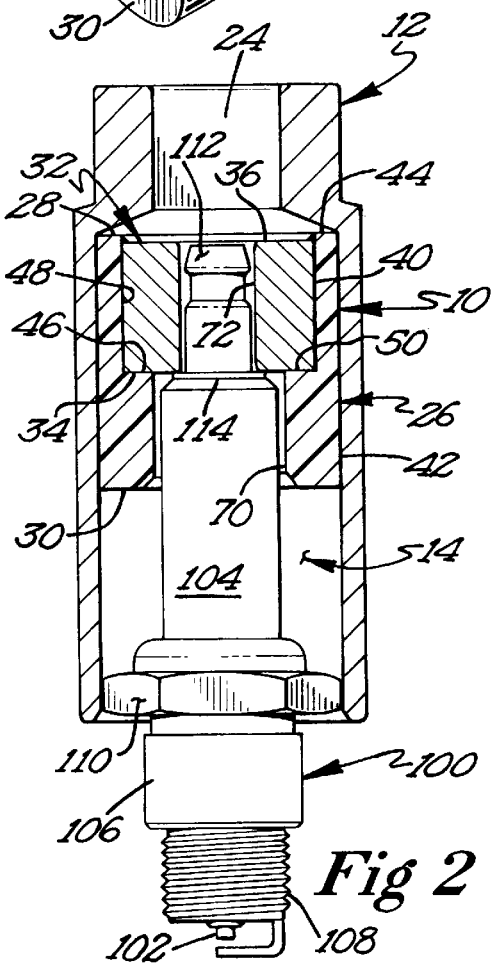
FIG. 2 shows a cross sectional view of the wrench socket and spark plug keeping accessory of FIG. 1 and including a spark plug.

In a first preferred form of the present invention shown in FIGS. 1 and 2, magnet 32 has annular cross sections or in other words is annular shaped and specifically includes an axial passage 72 extending between faces 34 and 36 and which is preferably located concentrically within periphery 40. In particular, axial passage 72 has a radial size generally equal to but preferably slightly larger than and for receipt of connecting nut 112 without binding and generally equal to but preferably slightly smaller than and for abutment with disk 114. The axial length of axial passage 72 generally corresponds to the axial length of connecting nut 112 and in the preferred form is shorter than the axial length of connecting nut 112. With magnet 32 including axial passage 72, axial bore 70 can extend to and intersect with lower wall 50 of recess 46 as well as axial passage 72.

Figure 3:
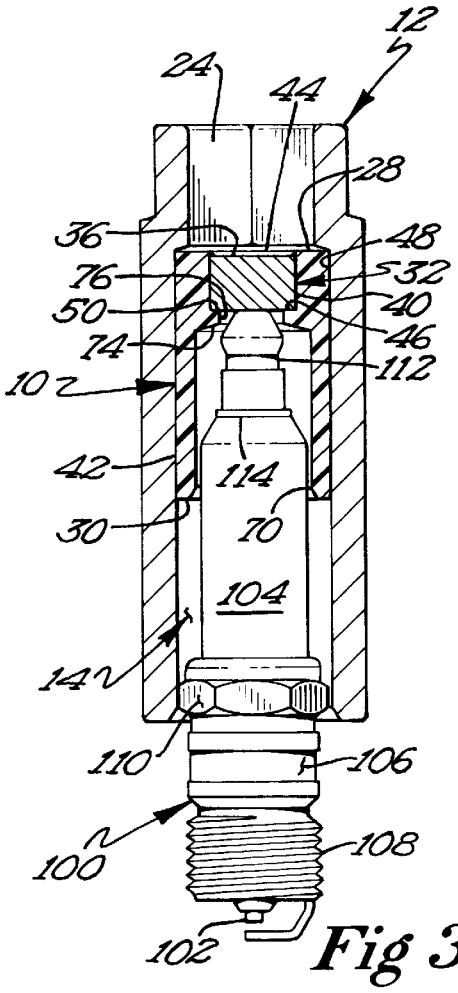
FIG. 3 shows a cross-sectional view of the wrench socket and an alternate embodiment of a spark plug keeping accessory according to the preferred teachings of the present invention and including a spark plug.

In an alternate preferred form of the present invention shown in FIG. 3, magnet 32 is of a solid cylindrical shape and specifically is free of passages intersecting faces 34 and 36 and/or periphery 40. With magnet 32 of a solid configuration, axial bore 70 can extend to and is defined by an upper wall 74 which is axially spaced from lower wall 50 of recess 46. An interconnecting axial bore 76 extends between upper wall 74 and axial bore 70 and lower wall 50 and recess 46. Axial bore 76 has a radial size generally equal to but preferably slightly larger than and for receipt of connecting nut 112 and smaller than axial bore 70. The axial length of axial bore 76 is shorter than and preferably considerably shorter than the axial length of connecting nut 112.

Now that the basic construction of accessory 10 according to the preferred teachings of the present invention has been explained, the operation and subtle features of accessory 10 can be set forth and appreciated. Specifically, when it is desired to initially hold spark plug 100 captive within well 14 of socket 12, accessory 10 of the preferred form shown can be positioned adjacent the open end of well 14 with periphery 42 of disk 26 extending over the inner periphery of well 14 and abutting with socket 12. At that time, accessory 10 can be pushed forcing disk 26 to pass into well 14 to compress disk 26 into well 14 with a snug, friction fit. Accessory 10 can be pushed into well 14 until face 28 is adjacent to or abuts with the handle mounting end and closes off the inner end of opening 24 of socket 12.

After accessory 10 is positioned in socket 12, socket 12 can be utilized in a very similar manner as socket 12 would be if it did not include accessory 10. As an example in the removal of spark plug 100 from an engine block, socket 12 is moved such that connecting nut 112 initially extends into well 14. As socket 12 is continued to move towards the engine block, connecting nut 112 will move deeper into well 14 until it extends into axial bore 70 of accessory 10. As socket 12 is again continued to move towards the engine block and with accessory 10 of the form of FIGS. 1 and 2, connecting nut 112 will extend into axial passage 72 of magnet 32 whereas with accessory 10 of the form of FIG. 3, connecting nut 112 will extend into axial bore 76. If not rotationally aligned, socket 12 with accessory 10 is rotated relative to the engine block until sides 18 and corners 20 of well 14 are aligned with hexagon nut 110 of spark plug 100. At which time, socket 12 is further moved towards the engine block until hexagon nut 110 is moved inside of well 14 in a nonslipping manner. At that time, socket 12 is rotated by any desired wrench handle. As hexagon nut 110 is located in well 14, rotation of socket 12 results in rotation of spark plug 100 relative to the engine block to thereby remove threaded portion 108 from the threaded opening of the engine block. After spark plug 100 has been threaded out of the engine block, socket 12 can be moved away from the engine block.

It should be appreciated that after spark plug 100 has been threaded out of the engine block and while socket 12 is moved away from the engine block, accessory 10 will hold spark plug 100 captive in socket 12 according to the teachings of the present invention. In particular, with accessory 10 of the form of FIGS. 1 and 2, magnet 32 will be magnetically attached to the sides of connecting nut 112 if formed of magnetic material and/or will be magnetically attached to disk 114. It can be appreciated that accessory 10 of the form of FIGS. 1 and 2 is especially advantageous in the ability to hold spark plugs 100 whether or not connecting nut 112 is formed of magnetic material and whether or not connecting nut 112 is threaded on the conductor 102. With accessory 10 of the form of FIG. 3, magnet 32 will be magnetically attached to the top of connecting nut 112 if formed of magnetic material or the top of conductor 102 if connecting nut 112 is not present. Thus, socket 12 including spark plug 100 can be moved to a position away from the engine block where threaded portion 108 can be grasped and spark plug 100 pulled from socket 12. It can be appreciated that the magnetic attachment force between magnet 32 and spark plug 100 will hold spark plug 100 captive in socket 12 during normal movement of socket 12 but allows spark plug 100 to be removed from socket 12 when desired such as by pulling on spark plug 100 as described and without resulting in movement of accessory 10 in well 14. Installation or replacement of spark plug 100 can be accomplished by generally reversing the removal procedure.

Often spark plugs 100 are located in depressions or cavities in the engine block which were of a size generally only larger than socket 12. Also, since considerable operation pressure is experienced, the tolerance between threaded portion 108 and the threaded opening in the engine block is minimized. Additionally, spark plugs 100 are often arranged generally vertical in engine block and will tend to slide from socket 12 (without accessory 10 according to the teachings of the present invention) when socket 12 is vertically oriented. Thus, prior to the present invention, two handed operation was often required with one hand holding the wrench including socket 12 while the other hand held spark plug 100 in socket 12, which was extremely difficult if working in close quarters such as when spark plugs 100 are received in depressions or cavities. Accessory 10 according to the teachings of the present invention is advantageous in allowing socket 12 to be moved relative to the engine block without spark plugs 100 falling from socket 12 so that single hand operation is possible. Additionally, receipt of connecting nut 112 in axial passage 72 or bore 76 and/or of insulator 104 inside of axial bore 70 has sufficient tolerance to self center spark plug 100 in socket 12 while preventing canting of spark plug 100 inside of well 14 of socket 12 which can occur if accessory 10 were not present. This feature is especially advantageous in initially threading threaded portion 108 into the engine block during installation of spark plug 100. This feature is also advantageous in guiding spark plug 100 into socket 12 especially to remove spark plug 100 from the engine block. The possibility of breaking or otherwise damaging insulator 104 is thereby reduced.

Due to the mounting of magnet 32 spaced within and from periphery 42 of disk 26 and the smaller diameter of magnet 32 than well 14, socket 12 is magnetically insulated from magnet 32 by disk 26. Specifically, due to the nonmagnetic material forming disk 26, disk 26 effectively prevents passage of the magnetic field of magnet 32 to socket 12. Thus, although spark plug 100 positioned within well 14 and abutting with magnet 32 will be attracted to and held by magnet 32 within well 14 of socket 12, the magnetic field created within socket 12 itself and the captured spark plug 100 will not be sufficient to be detrimentally attracted to any metal in the path of socket 12 to the fastening location as well as metal surrounding the fastening location. In this regard, the height of recess 46 between lower wall 50 and face 28 can be slightly greater than the height of magnet 32 between faces 34 and 36 so that magnet 32 is inset below face 28. Thus, there is less likelihood that face 36 of magnet 32 will engage the handle mounting end or any other portion of socket 12. However, the magnetic attraction of magnet 32 with the handle mounting end of socket 12 assists in the removable retention of accessory 10 in socket 12 according to the teachings of the present invention.

Due to the magnetic insulation of magnet 32 by disk 26, the magnetic attraction between spark plug 100 and magnet 32 is enhanced. Thus, the strength required for magnet 32 to effectively capture spark plug 100 within well 14 is minimized, with the attraction of socket 12 to metal (which is dependent on the strength of magnet 32) also being minimized.

It should be appreciated that sockets 12 are made by various manufacturers and are of various designs and configurations including with varying number of sides 18 forming well 14. However, as sockets 12 of whatever design must correspond to and slideably receive hexagon nut 110 of spark plug 100 to be operable, the diameter of corners 20 must be generally standard and corresponding to that of hexagon nut 110. Accessory 10 according to the teachings of the present invention takes advantage of this feature to allow use in conventional sockets 12 of whatever design and without modification. Specifically, disk 26 can be sized according to the diameter of corners 20 of the particular sized socket 12 for which accessory 10 is desired to be utilized. In its most preferred form, disk 26 can then be pushed into well 14 of socket 12 elastically deforming to match the periphery of well 14 regardless of the number and/or configuration of sides 18 of the particular socket 12 which accessory 10 is to be utilized. In fact, as accessory 10 is bound in well 14 by disk 26 deforming inside and along sides 18, high tolerances are possible between the relationship between the diameters of disk 26 and corners 20 such that accessory 10 can be utilized through a range of socket sizes such as for generally corresponding standard American (inch) or metric sizes. Thus, accessory 10 according to the teachings of the present invention is relatively inexpensive to fabricate and is versatile in application for the benefit of the average or experienced end user.

Further, in addition to being usable with most makes or models of sockets 12 without need for modifying socket 12, accessory 10 can be removed easily from socket 12 by pushing an elongated member through opening 24 thereby forcing accessory 10 from socket 12 and allowing standard use of socket 12. Also, any build up of grease, dirt, oil or the like can be wiped from accessory 10 after its removal from socket 12. Due to the resilient, compressible nature of disk 26 of the most preferred form, disk 26 generally returns to its original shape so that accessory 10 can be inserted into and removed from well 14 a multiplicity of times without detrimentally affecting the utilization of accessory 10.

It should be noted that shock or pounding forces can result in chipping, demagnetization, or other damage to magnet 32. In addition to removably positioning magnet 32 into and magnetically insulating magnet 32 from socket 12, disk 26 takes up and absorbs vibration or shock in applying torque to socket 12 to fasten or loosen threaded portion 108.

Additionally, due to the snug fit, accessory 10 is slideably adjustable inside of well 14 to positions spaced from the handle mounting end of socket 12 so that accessory 10 can be adjustably positioned in well 14 by passing an elongated member through opening 24 and pushing against face 28 and/or 36 to slide accessory 10 to the desired position inside of well 14. In any case, accessory 10 according to the teachings of the present invention is positioned spaced from the open end of well 14 and adjacent the handle mounting end of socket 12 so that it is typically clear of oil and grease contact.

Now that the basic teachings of the present invention have been explained, many extensions and variations will be obvious to one skilled in the art. For example, although in the most preferred form several unique and novel features have been utilized producing synergistic results, such features could be utilized separately or in other combinations according to the teachings of the present invention. As an example, in the most preferred form shown, axial bore 70 is shown of a generally cylindrical shape. However, axial bore 70 could be formed of other shapes including but not limited to frustoconical and which enhance guiding spark plug 100 into well 14 and accessory 10 according to the teachings of the present invention.

Likewise, although the presence of axial bore 70 is believed advantageous for several reasons including the enhancement of guiding spark plug 100 and of the increased retention of accessory 10 in well 14 due to its elongated length, accessory 10 according to the teachings of the present invention could have a height generally equal to the height of magnet 32 between faces 34 and 36 especially when magnet 32 includes axial passage 72.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Accessory for use in a wrench socket without need for modifying the wrench socket, with the wrench socket being of a conventional design including a well having an inner periphery formed by multiple sides intersecting at outer corners, with the well slideably receiving a spark plug, with the spark plug including a body having a threaded portion and a nut portion, with the spark plug further including an insulator extending from the body and terminating in an electrode disk against which a connecting nut abuts, with the electrode disk being formed of magnetic material, with the accessory preventing the spark plug from sliding from the well to hold the spark plug captive in the well while the socket is being moved relative to a fastening location, comprising, in combination: a magnet having, a periphery smaller than the inner periphery of the well; and a nonmagnetic disk including opposed, first and second faces, a periphery, and a recess for receipt of the magnet and extending at a depth from the second face of the nonmagnetic disk towards the first face of the nonmagnetic disk and spaced from the periphery of the nonmagnetic disk, with the periphery of the nonmagnetic disk being adapted to pass into the inner periphery of the well, with the nonmagnetic disk including an axial bore of a size for slideable receipt of the connecting nut and the insulator of the spark plug, with the magnet being proximate to the connecting nut when the insulator is received in the axial bore of the nonmagnetic disk.

2. The accessory of claim 1 wherein the magnet includes an axial passage of a size for slideable receipt of the connecting nut.

3. The accessory of claim 2 wherein the size of the axial passage is adapted to abut with the electrode disk.

4. The accessory of claim 3 wherein the magnet is annular shaped.

5. The accessory of claim 1 wherein the recess is spaced from the first face of the magnetic disc, wherein the axial bore terminates in an upper wall spaced from the recess, with the nonmagnetic disk further including an interconnecting axial bore extending between the upper wall and the recess and of a size for slideable receipt of the connecting nut and of a radial size smaller than the axial bore.

6. The accessory of claim 1 wherein the magnet has a height, with the depth of the recess being greater than the height of the magnet; and wherein the magnet can be inset from the second face of the nonmagnetic disk to magnetically insulate the magnet from the socket.

7. The accessory of claim 1 wherein the periphery of the magnet is generally cylindrically shaped; wherein the recess is generally concentric within the periphery of the nonmagnetic disk; and wherein the periphery of the nonmagnetic disk is of circular cross sections.

8. The accessory of claim 1 wherein the nonmagnetic disk is formed of compressible material, with the nonmagnetic disk being elastically deformable under force to pass into and snugly fit within the inner periphery of the well.

9. Accessory for use in a wrench socket without need for modifying the wrench socket, with the wrench socket being of a conventional design including a well having an inner periphery formed by multiple sides intersecting at outer corners, with the well slideably receiving a spark plug, with the spark plug including a body having a threaded portion and a nut portion, with the spark plug further including an insulator extending from the body and terminating in an electrode disk against which a connecting nut abuts, with the electrode disk being formed of magnetic material, with the accessory preventing the spark plug from sliding from the well to hold the spark plug captive in the well while the socket is being moved relative to a fastening location, comprising, a magnet having a periphery smaller than the inner periphery of the well, with the magnet including an axial passagc of a size for slideable receipt of the connecting nut; and a nonmagnetic sleeve including opposed, first and second faces and a periphery, with the periphery of the nonmagnetic sleeve being adapted to pass into the inner periphery of the well, with the magnet being received in the sleeve.

10. The accessory of claim 9 wherein the size of the axial passage is adapted to abut with the electrode disk.

11. The accessory of claim 9 wherein the magnet is annular shaped.

12. The accessory of claim 9 wherein the periphery of the magnet is generally cylindrically shaped; wherein the periphery of the magnet is generally concentric within the periphery of the nonmagnetic sleeve; and wherein the periphery of the nonmagnetic sleeve is of circular cross sections.

13. The accessory of claim 9 wherein the magnet has a height, with the length of the nonmagnetic sleeve between the first and second faces being greater than the height of the magnet.

14. Spark plug keeper accessory comprising, a magnet having a periphery; and a nonmagnetic disk including opposed, first and second faces, a periphery, and an axial recess for receipt of the magnet, with the axial recess extending at a depth from the second face of the nonmagnetic disk towards the first face of the nonmagnetic disk, with the axial recess having a periphery of a size generally equal to the periphery of the magnet and being spaced from the periphery of the nonmagnetic disk, with the nonmagnetic disk including an axial bore extending from the first face of the nonmagnetic disk and being of a radial size, with the magnet being accessible from the first face of the nonmagnetic disk through the axial bore of the nonmagnetic disk.

15. The spark plug keeper accessory of claim 14 wherein the magnet includes an axial passage of a radial size smaller than the axial bore, with the axial bore intersecting with the axial recess and the axial passage intersecting with the axial bore.

16. The spark plug keeper accessory of claim 15 wherein the magnet is annular shaped.

17. The spark plug keeper accessory of claim 14 wherein the magnet has a height, with the depth of the axial recess being greater than the height of the magnet; and wherein the magnet can be inset from the second face of the nonmagnetic disk to magnetically insulate the magnet.

18. The spark plug keeper accessory of claim 14 wherein the radial size of the axial bore is different than the periphery of the axial recess, wherein the axial bore terminates in an upper wall spaced from the axial recess, with the nonmagnetic disk further including an interconnecting axial bore extending between the upper wall and the axial recess and of a radial size smaller than the axial bore.

19. The spark plug keeper accessory of claim 14 wherein the periphery of the magnet is generally cylindrically shaped; wherein the axial recess is generally concentric within the periphery of the nonmagnetic disk; and wherein the periphery of the nonmagnetic disk is of circular cross sections.

20. The spark plug keeper accessory of claim 14 wherein the nonmagnetic disk is formed of compressible material, with the nonmagnetic disk being elastically deformable under force to pass into and snugly fit within a socket.

* * * * *